US009119525B2

(12) United States Patent
Lemchen

(10) Patent No.: US 9,119,525 B2
(45) Date of Patent: Sep. 1, 2015

(54) APPARATUS FOR CLEANING A SCREEN AND METHOD FOR STORING THE SAME

(76) Inventor: Marc Lemchen, New York, NY (US)

( * ) Notice: Subject to any disclaimer, the term of this patent is extended or adjusted under 35 U.S.C. 154(b) by 530 days.

(21) Appl. No.: 13/426,241

(22) Filed: Mar. 21, 2012

(65) Prior Publication Data

US 2012/0240957 A1 Sep. 27, 2012

Related U.S. Application Data

(60) Provisional application No. 61/454,686, filed on Mar. 21, 2011.

(51) Int. Cl.

| | |
|---|---|
| ***B65D 81/24*** | (2006.01) |
| ***A47L 25/00*** | (2006.01) |
| ***B08B 1/00*** | (2006.01) |

(52) U.S. Cl.

CPC .. *A47L 25/00* (2013.01); *B08B 1/00* (2013.01)

(58) Field of Classification Search

USPC ..... 206/205, 207, 209, 210, 361, 15.2; 15/104.93; 401/195

See application file for complete search history.

(56) References Cited

U.S. PATENT DOCUMENTS

| | | | | |
|---|---|---|---|---|
| 5,607,081 | A * | 3/1997 | Levy | 222/83.5 |
| 6,343,612 | B1 * | 2/2002 | Dahl | 134/117 |
| 7,681,725 | B2 * | 3/2010 | Mueller et al. | 206/210 |
| 7,712,606 | B2 * | 5/2010 | Salahieh et al. | 206/210 |
| 8,136,659 | B2 * | 3/2012 | Salahieh et al. | 206/210 |
| 8,365,949 | B2 * | 2/2013 | Serfaty | 221/34 |
| 8,496,108 | B2 * | 7/2013 | Bahcall | 206/210 |
| 2001/0019064 | A1 * | 9/2001 | Jacques et al. | 221/63 |
| 2009/0090723 | A1 * | 4/2009 | Holbrook et al. | 220/521 |
| 2009/0099531 | A1 * | 4/2009 | Griesbach, III | 604/265 |
| 2012/0132547 | A1 * | 5/2012 | Salahieh et al. | 206/210 |

* cited by examiner

*Primary Examiner* — Jacob K Ackun

(74) *Attorney, Agent, or Firm* — Marcus C. Dawes; Daniel L. Dawes

(57) ABSTRACT

An apparatus for cleaning the touch screen of any personal electronic device, including but not limited to smart phones and personal computing tablets. The apparatus comprises a wet portion and a dry portion in a substantially horizontal figure "8" configuration. The apparatus may also comprise a reservoir for storing a volume of conventional cleaning fluid. When not in use, the apparatus is slid into a case which is configured to house the wet and dry portions of the apparatus in separate housing compartments. A method is also provided for storing the apparatus when not in use so as to prolong its effective lifespan and improve its overall performance.

8 Claims, 2 Drawing Sheets

APPARATUS FOR CLEANING A SCREEN AND METHOD FOR STORING THE SAME

RELATED APPLICATIONS

The present application is related to U.S. Provisional Patent Application Ser. No. 61/454,686, filed on Mar. 21, 2011, which is incorporated herein by reference and to which priority is claimed pursuant to 35 USC 119.

BACKGROUND

1. Field of the Technology

The disclosure relates to the field of maintenance of personal electronics, specifically to the cleaning of a screen of a personal electronic device and method for storing the same.

2. Description of the Prior Art

The use of small portable electronic devices has exploded in recent modern day society and will only increase as the technology becomes cheaper and easier to use. Devices such as smart phones and computer tablets with touch screen displays lead the way in disseminating powerful computing power and access to information to the mass public. Specifically it is the implementation of touch screen displays which provide intuitive and user friendly navigation techniques and allows individuals with even the most rudimentary computer skills to effectively use the device.

A significant drawback of the touch screen however is that the touch screen itself becomes dirty and covered in unwanted oils and fingerprints from the user making use of the device more difficult if not unpleasant. This problem is magnified several times over in cases where the device is shared between several people such as in a patient waiting room or within a classroom where the device may act as a transmission means for germs to spread from user to user.

Previous attempts to clean touch screen devices have included lint free cloths which do help remove large dirt or soil particles, but lack the ability to remove or kill bacteria and other germs which may be present. Other attempts have included using paper towels and a cleaning spray, however these additional items are bulky and are impractical for use when traveling or otherwise on the move.

What is needed is an apparatus that may be used to clean the touch screens of modern day electronic devices and thus cut down on the grime and amount of germs present on the device while still being as portable as the devices themselves. The apparatus should also comprise a method for being properly stored so as to prolong the functionality of the apparatus.

BRIEF SUMMARY

The current invention is for a system that effectively cleans the touch screen of any personal electronic device, including but not limited to smart phones and personal computing tablets such as the iPad®. The invention also includes a method for storing the apparatus when not in use so as to prolong its effective lifespan and improve its overall performance.

The current invention is a system for cleaning a touch screen of a personal electronics device including a cleaning stick with a wet portion and a dry portion with the wet and dry portions are adjacently disposed to one another. The system also includes a case with a wet housing and a dry housing also adjacently disposed to one another. The wet and dry portions of the cleaning stick are capable of being inserted in the wet and dry housing respectively. The system also includes a cap which is removably coupled to the case.

In one embodiment, the dry housing of the case has a surface and includes a plurality of perforations defined through it which communicate the dry housing of the case with a surrounding ambient environment.

In another embodiment, the wet portion of the cleaning stick has a larger cross sectional diameter than the dry portion of the cleaning stick.

The case included in the system has a longitudinal length and further includes a seal disposed along the longitudinal length for preventing contact between the wet portion and dry portion of the cleaning stick. In other embodiments, the case further comprises a reservoir disposed along its longitudinal length.

In another embodiment, the wet housing of the case is prismatically shaped and has a larger cross sectional area than that of the dry housing of the case. A handle may also be connected to the cleaning stick.

In yet another embodiment, the reservoir within the case is fluidicly communicated with only the wet portion of the cleaning stick when the cleaning stick is inserted into the case.

The invention further provides for a method for storing a cleaning stick used to clean a touch screen of a personal electronic device including aligning the cleaning stick to match a longitudinal orientation of a case, inserting the cleaning stick into the case, maintaining a fluidic barrier between a wet portion and a dry portion of the cleaning stick when it is the case, and then enclosing the cleaning stick within the case.

In one embodiment, the method step of aligning the cleaning stick to match the longitudinal orientation of the case includes aligning the wet portion of the cleaning stick with a wet housing of the case and then aligning the dry portion of the cleaning stick with a dry housing of the case.

In another embodiment, the method step of maintaining a fluidic barrier between a wet portion and a dry portion of the cleaning stick when it is the case includes confining the wet portion of the cleaning stick within a wet housing of the case and then confining the dry portion of the cleaning stick within a dry housing of the case. The dry portion of the cleaning stick may be air dried when it is inserted in the dry housing of the case via a plurality of perforations defined through a surface of the dry housing.

In yet another embodiment, the method also includes fluidicly communicating the wet portion of the cleaning stick with a reservoir disposed within the case.

In yet another embodiment, the method step of maintaining a fluidic barrier between a wet portion and a dry portion of the cleaning stick when it is the case includes providing a seal between the wet portion and the dry portion of the cleaning stick as the cleaning stick is inserted into the case.

In another embodiment, the method step of enclosing the cleaning stick within the case further includes coupling a cap to the end of the case.

In still a further embodiment, the method step of inserting the cleaning stick into the case includes inserting the wet portion of the cleaning stick into a wet housing of the case, inserting the dry portion of the cleaning stick into a dry housing of the case, and then preventing the insertion of the wet portion of the cleaning stick into the dry housing of the case.

The current invention also provides for an apparatus for storing a cleaning stick used to clean a touch screen of a personal electronics device. The apparatus includes a case with two portions, wherein each portion of the case is configured to accommodate a corresponding portion of the cleaning stick. A fluidic barrier is also disposed longitudinally along a longitudinal axis of the case, and a cap is also removably coupled to the case.

In one particular embodiment, the case portion of the apparatus also includes a refillable reservoir disposed longitudinally along the longitudinal axis of the case. The reservoir is fluidicly communicated with only one portion of the cleaning stick and includes means for air drying the remaining portion of the cleaning stick.

In another embodiment, the two portions of the case of the apparatus have unequal volumes.

Finally, the case may be attachable to the personal electronics device or fixed thereto as needed.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The disclosure can be better visualized by turning now to the following drawings wherein like elements are referenced by like numerals.

The disclosure and its various embodiments can now be better understood by turning to the following detailed description of the preferred embodiments which are presented as illustrated examples of the embodiments defined in the claims. It is expressly understood that the embodiments as defined by the claims may be broader than the illustrated embodiments described below.

DETAILED DESCRIPTION OF THE PREFERRED EMBODIMENTS

Figure 1:
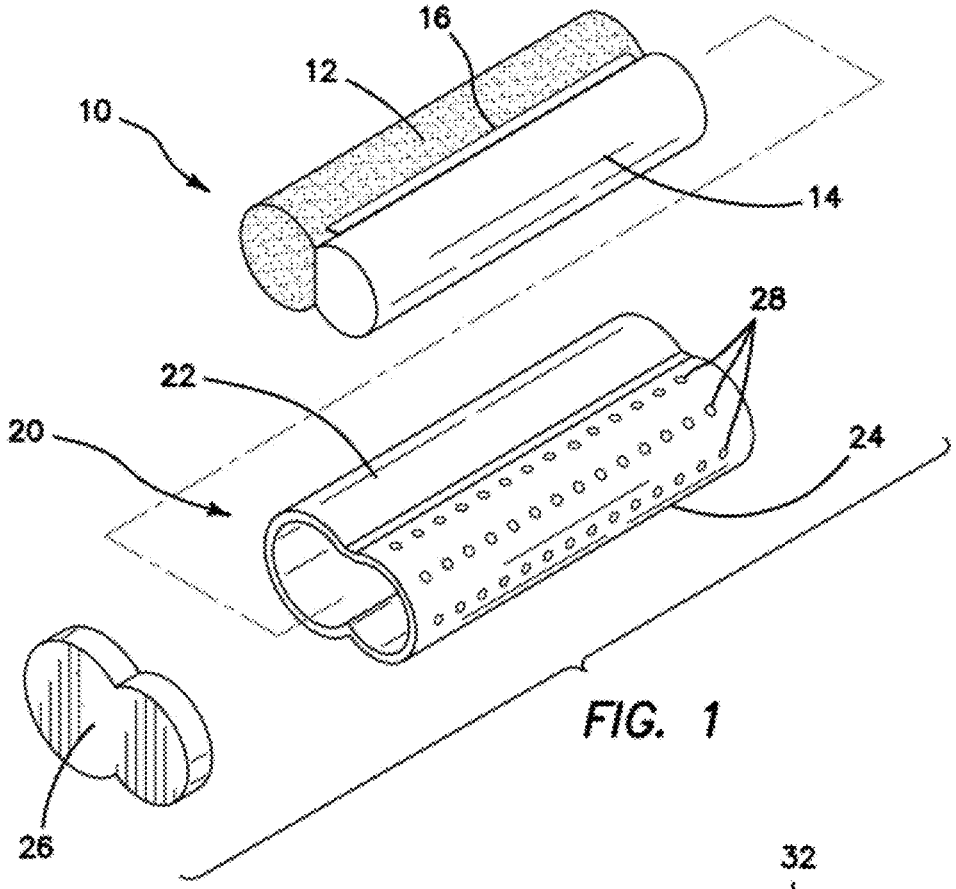
FIG. 1 is an exploded perspective view of the current system comprising a cleaning stick, case, and cap.

The current apparatus is a cleaning "stick" or rod 10 as seen in FIG. 1 used to clean the surface of touch screens for various personal electronic devices. The cleaning stick 10 is a substantially narrow rod-like structure comprising two rounded halves coupled together along a longitudinal axis. Each of the halves are separately designated as a wet half 12 and a dry half 14. The wet half 12 and dry half 14 are both preferably comprised of soft, sponge material, however any material or material composite now known or later devised for applying or absorbing moisture may be used without departing from the original spirit and scope of the invention.

Both the wet half 12 and dry half 14 are substantially circular or semi-circular in shape, however the dry half 14 comprises a smaller diameter than that of the wet half 12. This allows the cleaning stick 10 to have an asymmetrical cross section as seen in FIG. 1, similar to a horizontal figure "8" shape with one half being smaller than the adjacent half. Alternatively, in another embodiment, the wet half 12 instead of the dry half 14 may be the smaller of the two halves. Coupled to the cleaning stick 10 and disposed between the wet half 12 and dry half 14 is a handle 16 which is used to grip the cleaning stick 10 during use.

Figure 4:
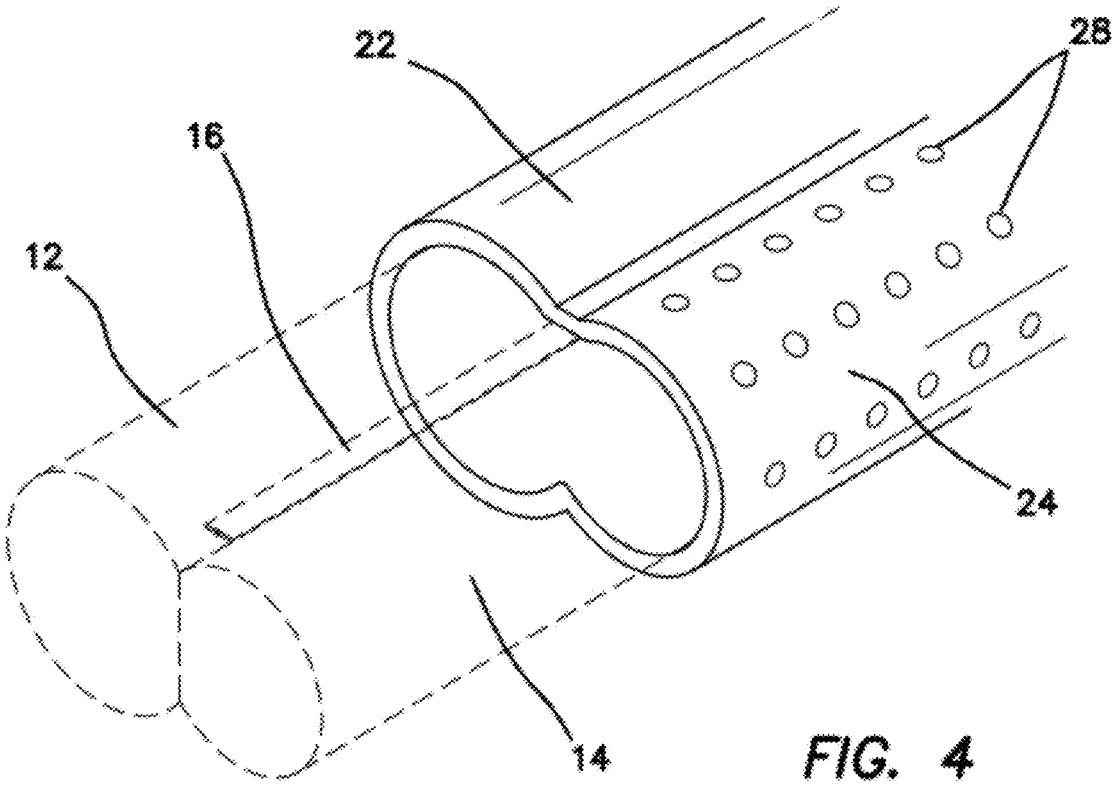
FIG. 4 is a perspective view of the cleaning stick being inserted into the case.
Figure 5:
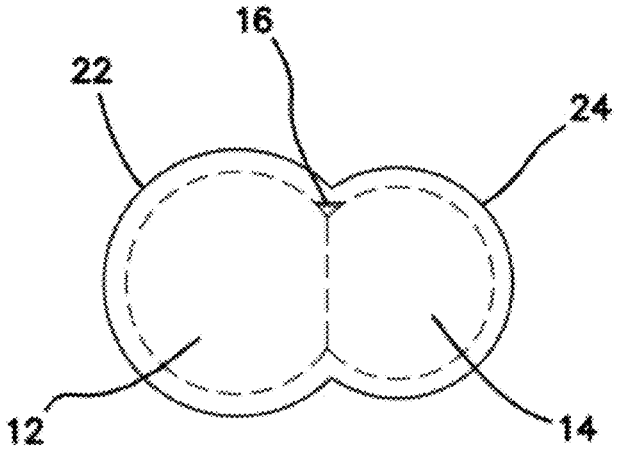
FIG. 5 is an end view of the cleaning stick after being fully inserted into the case.

The current apparatus also comprises a storage case 20 as seen in FIG. 1 that comprises the same horizontal figure "8" cross section as the cleaning stick 10. The storage case 20 comprises a wet housing 22 and a dry housing 24 disposed next to one another which are sized and shaped to accommodate the wet half 12 and dry half 14 of the cleaning stick 10, respectively. The storage case 20 is preferably comprised of plastic or plastic composite, however any light weight durable material may be used without departing from the original spirit and scope of the invention. When not in use, the cleaning stick 10 is inserted into the storage case 20 with the wet half 12 aligned within the wet housing 22 and the dry half 14 aligned within the dry housing 24 as seen in FIGS. 4 and 5. The figure "8" cross sections of both the cleaning stick 10 and storage case 20 ensure that only the wet half 12 of the cleaning stick 10 is inserted into the wet housing 22 of the storage case 20, and that the dry half 14 is inserted into the dry housing 24. If the wet half 12 of the cleaning stick 10 is mistakenly aligned with the dry housing 24 portion of the case 20, the diameter of the dry housing 24 which is smaller than that of the wet half 12, will prevent the wet half 12 from being inserted into the case 20. In other words, the storage case 20 will only accommodate the cleaning stick 10 if it is properly orientated in the proper configuration, i.e. the wet half 12 disposed in front of the wet housing 22 and the dry half 14 disposed in front of the dry housing 24.

When the cleaning stick 10 is not in use or has just finished being used, the stick 10 is orientated as described above and then slid distally into the storage case 20, as best seen in the end view of the stick 10 and case 20 in FIG. 5. The wet housing 22 is sized to be slightly larger than the wet half 12 so as to provide a snug or tight fit and thus prevent any residual moisture from evaporating and drying out the wet half 12. The dry housing 24 also comprises a plurality of perforations 28 defined in its surface as seen in FIG. 1. The perforations 28 permit moisture collected from the dry half 14 to evaporate and pass through the dry housing 24 and into the surrounding environment. It is in this fashion therefore that the wet half 12 remains moist while the dry half 14 is permitted to air dry between uses.

After the cleaning stick 10 has been completely slid distally into the storage case 20, a cap 26 is placed over the proximal end of the storage case 20 to seal in the cleaning stick 10. The cap 26 comprises the same horizontal figure "8" shape as the cross section of the storage case 20 and not only holds the cleaning stick 10 within the storage case 20, but also helps to prevent further moisture depletion from the wet half 12.

To use the cleaning stick 10, the cap 26 is removed and the cleaning stick 10 is slid proximally out of the storage case 20. The user grips the cleaning stick 10 by the handle 16 and presses the wet half 12 against the surface of the touch screen of the electronic device to be cleaned. The wet half 12 preferably already contains a liquid cleaning agent within its sponge-like material, however cleaning agents may be applied to the surface of the touch screen by known means by the user before applying the wet half 12. The wet half 12 is then maneuvered around the touch screen, spreading the cleaning agent and breaking down any dirt or oils present. The user then orientates the cleaning stick 10 so that the dry half 14 is in contact with the touch screen surface and then repeats the wiping process and absorbs moisture left behind from the wet half 12. The cleaning stick 10 may then be replaced into the storage case 20 as described above until needed again.

Figure 2:
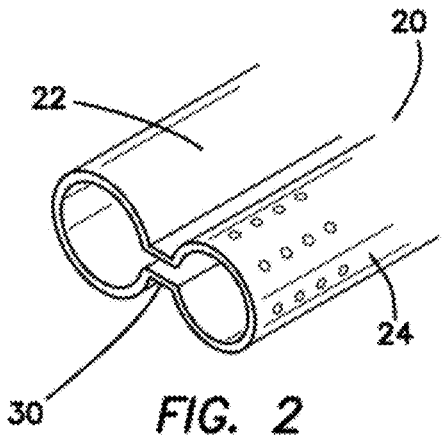
FIG. 2 is a perspective view of an alternative embodiment of the case comprising a seal.

In another embodiment seen in FIG. 2, the storage case 20 comprises a seal or other interlocking slide 30 disposed down the center of the storage case 20. The seal 30 is an effective physical barrier along the longitudinal length of the storage case 20 which prevents contact between the wet half 12 and dry half 14 of the cleaning stick 10 while it is contained within the storage case 20. In this particular embodiment, the cleaning stick 10 also comprises a narrowed segment along its longitudinal length between the wet half 12 and dry half 14 so as to snuggly fit within the seal 30.

Figure 3:
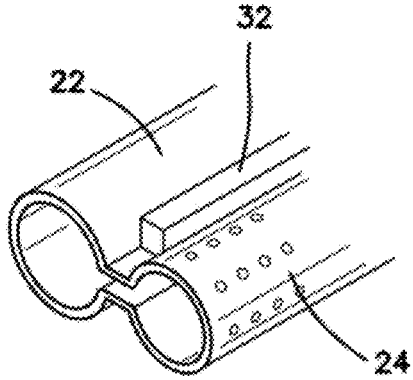
FIG. 3 is a perspective view of an alternative embodiment of the case comprising a reservoir.

In another embodiment seen in FIG. 3, the storage case 20 comprises a reservoir 32 disposed along its longitudinal length. When the cleaning stick 10 is inserted into the storage case 20 as disclosed above, the wet half 12 of the cleaning stick makes fluidic contact with the reservoir 32, transferring fresh cleaning agent from the reservoir 32 to the wet half 12 by means known in the art. The reservoir 32 may be refilled via a port or a one way valve defined within the outer surface of the storage case 20. In this embodiment, each time the cleaning stick 10 is removed from the storage case 20, the wet half 12 already has cleaning agent applied to it due to contact with the reservoir 32 making the cleaning stick 10 ready for immediate use. After use, the cleaning stick 10 is inserted back into the storage case 20 allowing the wet half 12 to replenish its supply of cleaning agent from the reservoir 32.

Many alterations and modifications may be made by those having ordinary skill in the art without departing from the spirit and scope of the embodiments. Therefore, it must be understood that the illustrated embodiment has been set forth only for the purposes of example and that it should not be taken as limiting the embodiments as defined by the following embodiments and its various embodiments.

Therefore, it must be understood that the illustrated embodiment has been set forth only for the purposes of example and that it should not be taken as limiting the embodiments as defined by the following claims. For example, notwithstanding the fact that the elements of a claim are set forth below in a certain combination, it must be expressly understood that the embodiments includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the embodiments is explicitly contemplated as within the scope of the embodiments.

The words used in this specification to describe the various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the embodiments.

I claim:

1. A system for cleaning a touch screen of a personal electronics device comprising:

a cleaning stick comprising a wet portion and a dry portion adjacently disposed to one another;

a case comprising a wet housing and a dry housing adjacently disposed to one another, wherein the wet and dry portions of the cleaning stick are disposable in the wet and dry housing respectively; and a cap removably coupled to the case.

2. The system of claim 1 wherein the dry housing of the case has a surface and includes a plurality of perforations defined through the surface communicating the dry housing of the case with a surrounding ambient environment.

3. The system of claim 1 wherein the wet portion of the cleaning stick has a larger cross sectional diameter than the dry portion of the cleaning stick.

4. The system of claim 1 wherein the case has a longitudinal length and further comprises a seal disposed along the longitudinal length.

5. The system of claim 1 wherein the case further comprises a reservoir disposed along its longitudinal length.

6. The system of claim 1 wherein the wet housing of the case has a larger cross sectional area than the dry housing of the case.

7. The system of claim 1 further comprising a handle coupled to the cleaning stick.

8. The system of claim 5 wherein the reservoir is fluidicly communicated with only to the wet portion of the cleaning stick when the cleaning stick is inserted into the case.

* * * * *